US006247983B1

(12) United States Patent
Yeh

(10) Patent No.: US 6,247,983 B1
(45) Date of Patent: Jun. 19, 2001

(54) ADJUSTING STRAP STRUCTURE FOR SWIM FINS

(76) Inventor: Tzong In Yeh, 1 Fl., No.5-1 Ho Tso Street, Taichung, 402 (TW)

( * ) Notice: Subject to any disclaimer, the term of this patent is extended or adjusted under 35 U.S.C. 154(b) by 0 days.

(21) Appl. No.: 09/542,829

(22) Filed: Apr. 4, 2000

(51) Int. Cl.[7] ..... A63B 31/08
(52) U.S. Cl. ..... 441/64
(58) Field of Search ..... 441/55, 61, 64; 36/11.5, 58.6

(56) References Cited

U.S. PATENT DOCUMENTS

D. 332,516 * 1/1993 Middleton ..... D2/290
4,795,385 * 1/1989 Matsuoka ..... 441/64
4,832,644 * 5/1989 Roberts ..... 441/64
5,183,424 * 2/1993 Field ..... 441/64
5,423,134 * 6/1995 Bagnaia et al. ..... 36/11.5

* cited by examiner

*Primary Examiner*—S. Joseph Morano
*Assistant Examiner*—Andrew Wright
(74) *Attorney, Agent, or Firm*—Rosenberg, Klein & Lee

(57) ABSTRACT

An adjusting strap structure for one of a pair of swim fins includes an elongated adjusting strap having two sides each having two distal ends, two first snapping members each mounted on a respective one of the two distal ends of one of the two sides of the adjusting strap, and at least one second snapping member mounted on the one side of the adjusting strap and located between the two first snapping members for detachably engaging with the two first snapping members. Each of the two distal ends of the adjusting strap extends through a respective one of the two side walls of the foot pocket, and then each of the two first snapping members are detachably engaged with the at least one second snapping member.

9 Claims, 10 Drawing Sheets

ADJUSTING STRAP STRUCTURE FOR SWIM FINS

BACKGROUND OF THE INVENTION

1. Field of the Invention

The present invention relates to an adjusting strap structure, and more particularly to an adjusting strap structure for a pair of swim fins.

2. Description of the Related Art

The closest prior art of which the applicant is aware is disclosed in U.S. Pat. No. 5,899,781 to McLaughlin, filed on Nov. 7, 1997, entitled by "SWIM FIN INCORPORATING PRONATION COMPENSATION STRUCTURE".

In the McLaughlin prior art, it disclosed a pair of swim fins each comprising a blade 3, a foot pocket 19, a heel strap 45 including two half heel straps 49 each having one distal end secured to the outside of the bottom portion 17 of the foot pocket 19 and the other distal end 53 arranged to come into overlapping contact with the other half heel strap 49 of the pair, and a coupling device 55 for connecting the half heel straps 49 together in temporary connection. The coupling device 55 includes a strip 57 fastened to the distal end 53 of one heel strap 49 and having a plurality of loop elements 61, a strip 63 fastened to the distal end 53 of the other heel strap 49 and having a plurality of hook elements 65 detachably engaged with the loop elements 61 for connecting the two half heel straps 49 together.

However, each of the two half heel straps 49 is fixed to the foot pocket 19 so that the length of the heel strap 45 relative to the foot pocket 19 cannot be arbitrarily varied. Accordingly, it is not easy to adjust the tension and relaxation of the heel strap 45 relative to the user's feet so that the heel strap 45 cannot fit users of different statures, thereby greatly limiting the versatility of the heel strap 45. In addition, the two half heel straps 49 of the heel strap 45 are directly in contact with the user's heel when the user wears the heel strap 45, thereby easily injuring the user's heel after long-term use due to frequent contact and scrubbing action.

SUMMARY OF THE INVENTION

In accordance with one aspect of the present invention, there is provided an adjusting strap structure for one of a pair of swim fins comprising an adjusting strap including two sides each having two distal ends, two first snapping members each mounted on a respective one of the two distal ends of one of the two sides of the adjusting strap, and at least one second snapping member mounted on the one side of the adjusting strap and located between the two first snapping members for detachably engaging with the two first snapping members.

Each of the two distal ends of the adjusting strap respectively extends through a respective one of the two side walls of the foot pocket of the swim fin, and each of the two first snapping members are detachably engaged with the at least one second snapping member. Each of the two side walls of the foot pocket defines a first hole and a second hole spaced from each other, and each of the two distal ends of the adjusting strap in turn passes through the first hole into the foot pocket, and then passes through the second hole to extend outward from the foot pocket.

According to an embodiment of the present invention, the adjusting strap structure comprises a second snapping member mounted on a mediate portion of the one side of the adjusting strap and located between the two first snapping members.

According to another embodiment of the present invention, the adjusting strap structure comprises two second snapping members each mounted on the one side of the adjusting strap and located adjacent to a respective one of the two first snapping members.

According to an embodiment of the present invention, the adjusting strap structure further comprises a third snapping member mounted on the other side of the adjusting strap and located opposite to one of the two first snapping members.

According to another embodiment of the present invention, the adjusting strap structure further comprises two third snapping members each mounted on the other side of the adjusting strap and each located opposite to a respective one of the two first snapping members, and two retaining strips each having one end attached to the one side of the adjusting strap and each including a fourth snapping member detachably engaged with a respective one of the two third snapping members.

The adjusting strap structure also comprises a flexible pad secured on a mediate portion of the adjusting strap and facing the foot pocket. The flexible pad includes an elongated body defining a plurality of lengthwise grooves and a plurality of crosswise slits intersecting the lengthwise grooves, and a protrusion protruding outward from a mediate portion of the elongated body and defining a plurality of crosswise grooves. The elongated body also defines an elongated recess for receiving the mediate portion of the adjusting strap.

Further benefits and advantages of the present invention will become apparent after a careful reading of the detailed description with appropriate reference to the accompanying drawings.

DETAILED DESCRIPTION OF THE INVENTION

Figure 1:
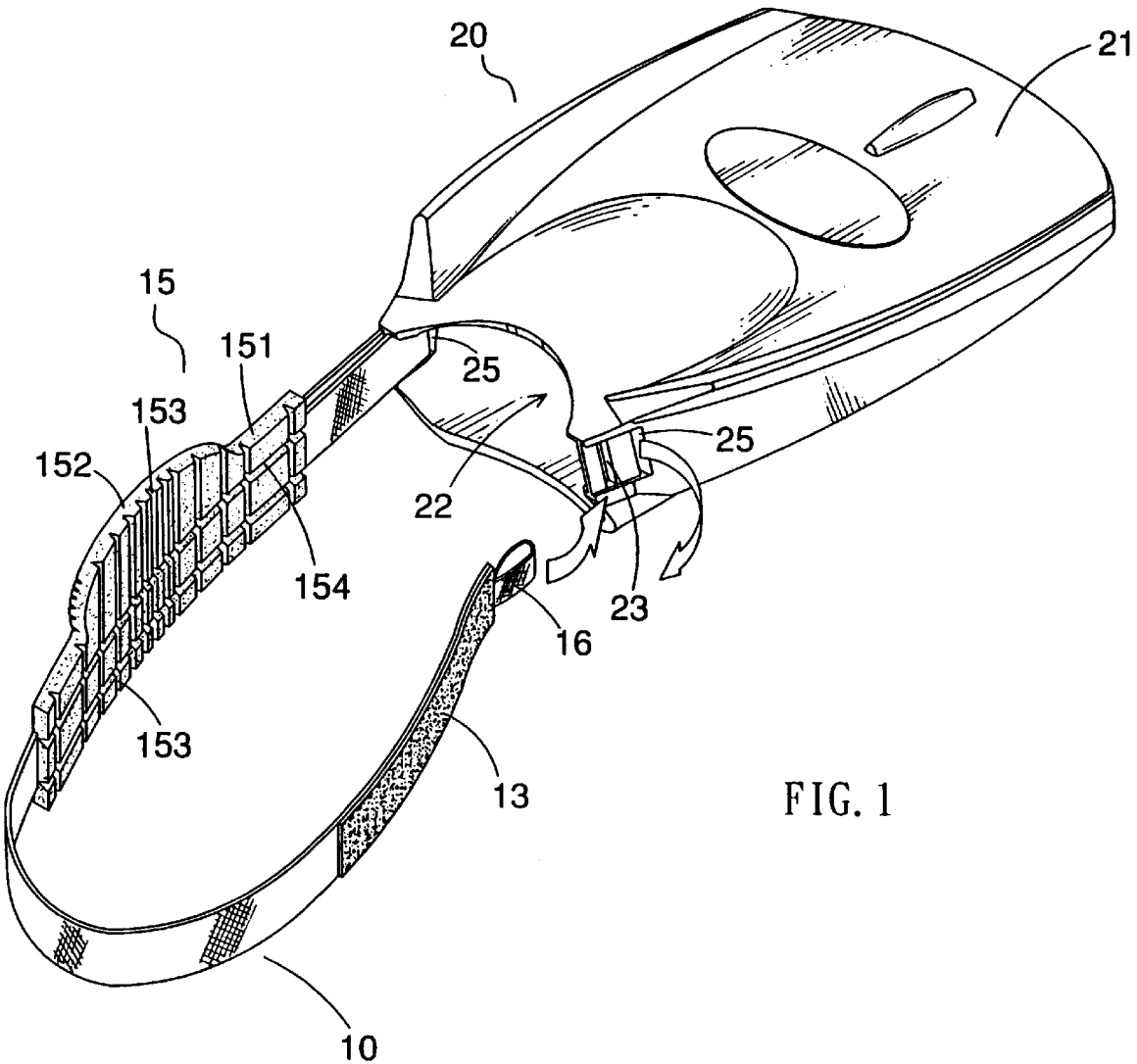
FIG. 1 is a perspective view of an adjusting strap structure for swim fins in accordance with the present invention.

Referring to the drawings and initially to FIGS. 1–4, an adjusting strap structure in accordance with the present invention is used for one of a pair of swim fins 20. Each of the swim fins 20 includes a blade 21, and a foot pocket 22 having two side walls each defining a first hole 23 and a second hole 25 spaced from each other.

The adjusting strap structure comprises an elongated adjusting strap made of a knitted fiber including two sides each having two distal ends, two first snapping members 11 and 13 each mounted on a respective one of the two distal ends of a first side of the adjusting strap 10, a second snapping member 12 mounted on the mediate portion of the first side of the adjusting strap 10 and located between the two first snapping members 11 and 13 for detachably engaging with the first snapping member 11, and a third snapping member 14 mounted on a second side of the adjusting strap I0 and located opposite to the first snapping member 11 for detachably engaging with the first snapping member 13. Each of the two distal ends of the adjusting strap 10 includes a pull tab 16 mounted thereon for facilitating the user holding the distal end of the adjusting strap 10. The snapping members 11, 12, 13 and 14 are made of hook/loop shaped elements (the so called"Velcro" strips) so that they can be detachably snapped with each other.

Figure 2:
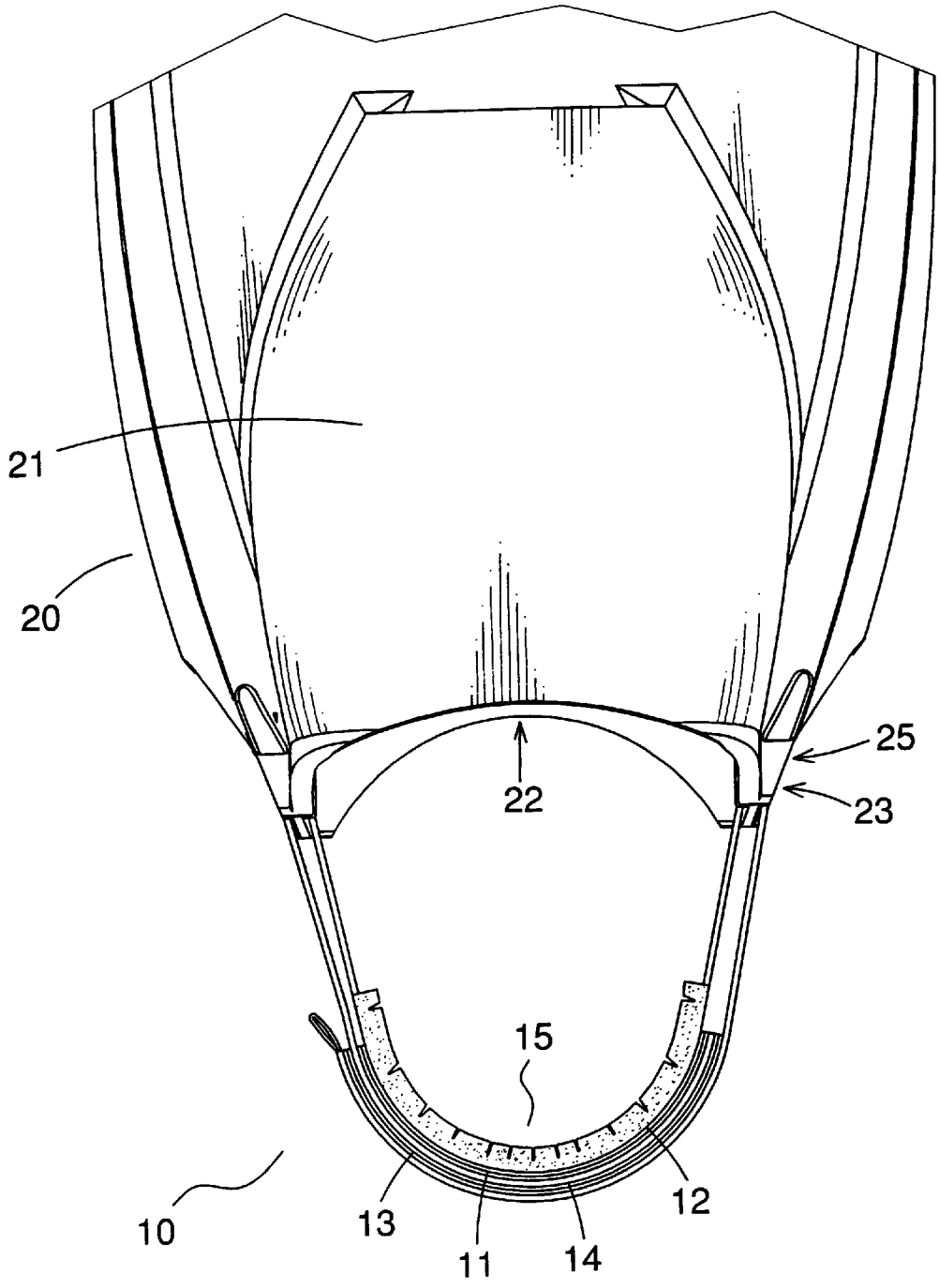
FIG. 2 is a top plan view of the adjusting strap structure as shown in FIG. 1.
Figure 3:
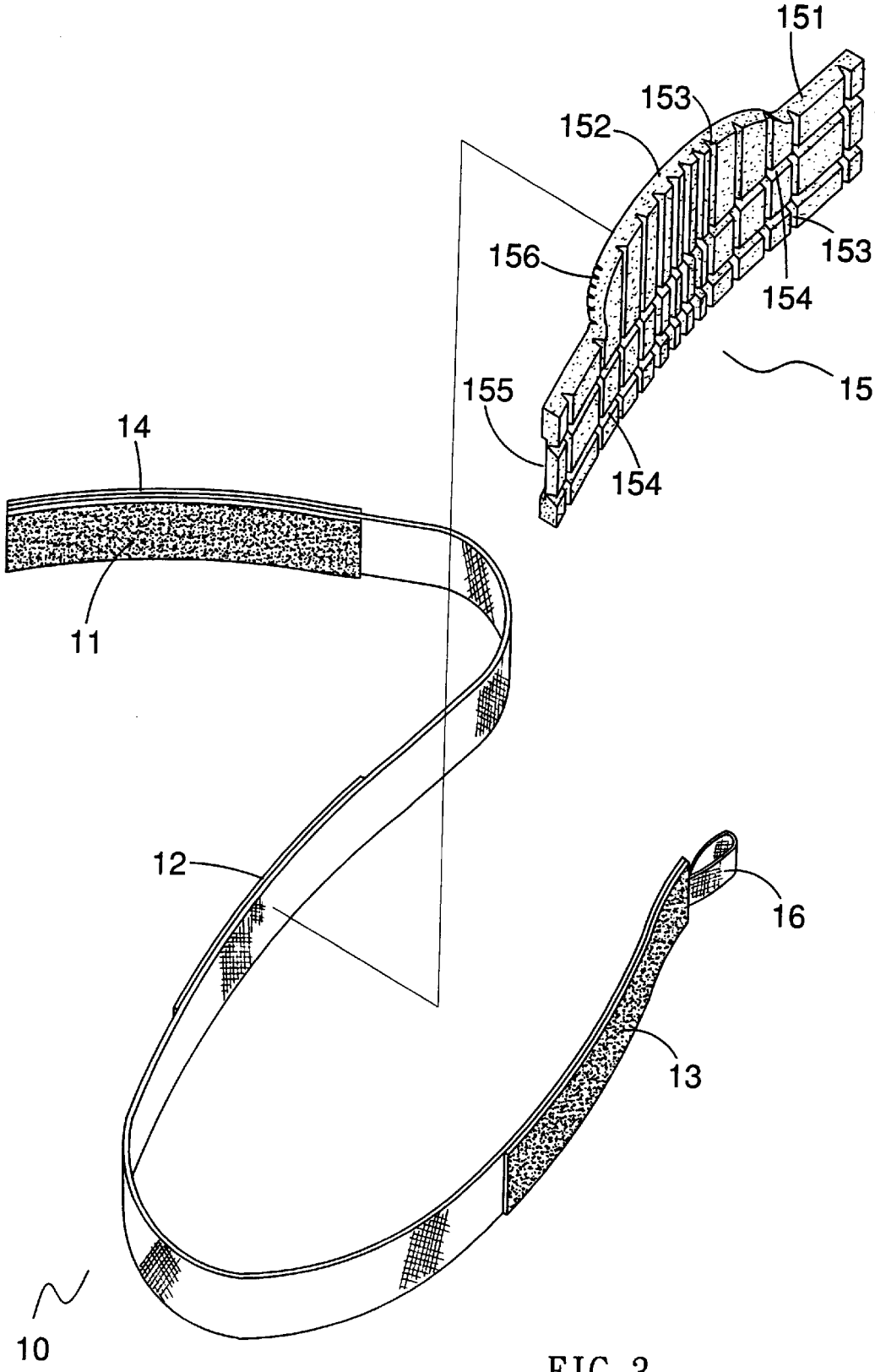
FIG. 3 is an exploded view of the adjusting strap structure as shown in FIG. 1.
Figure 4:
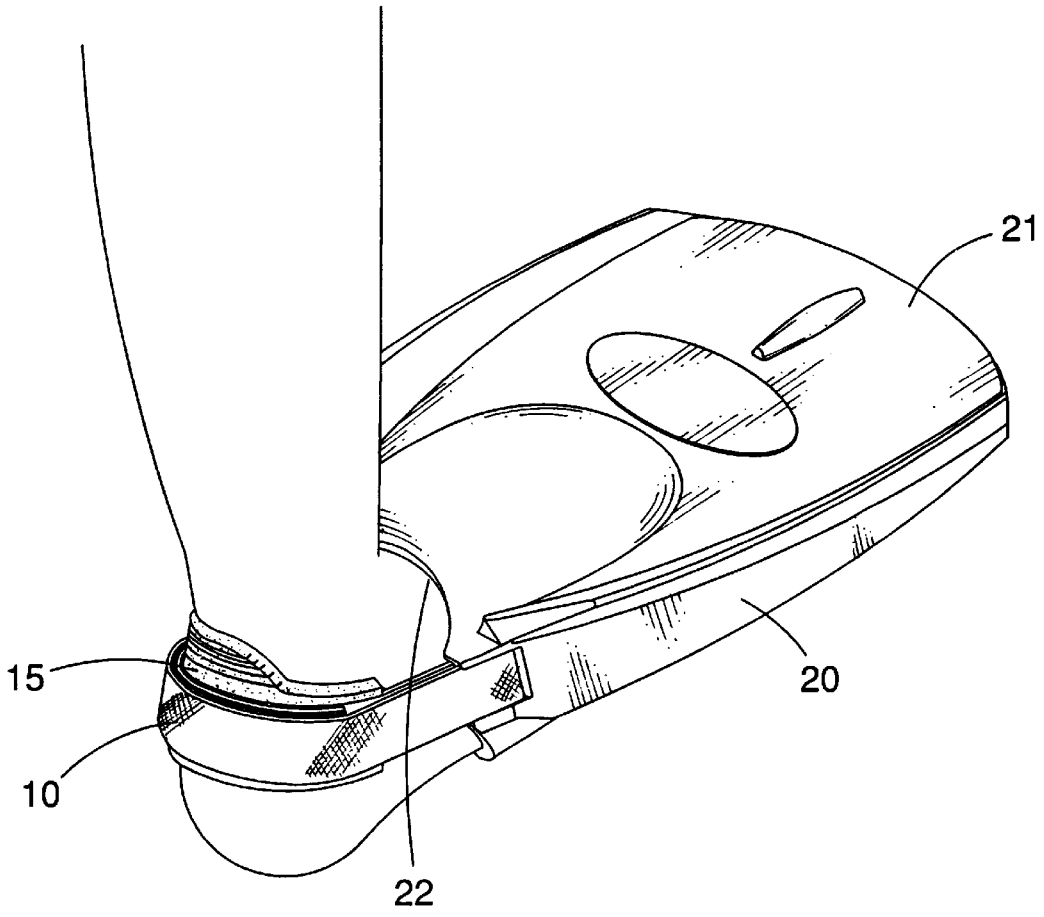
FIG. 4 is a schematic view of the adjusting strap structure as shown in FIG. 1 in use.

In operation, each of the two distal ends of the adjusting strap 10 respectively extends through a respective one of the two side walls of the foot pocket 22. Preferably, each of the two distal ends of the adjusting strap 10 in turn passes through the first hole 23 into the foot pocket 22, and then passes through the second hole 25 to extend outward from the foot pocket 22. In such a manner, the first snapping member 11 can then pass through the first and second holes 23 and 25 of the foot pocket 20 to be detachably engaged with the second snapping member 12, and the first snapping member 13 can then pass through the first and second holes 23 and 25 of the foot pocket 20 to be detachably engaged with the third snapping member 14, thereby securing the adjusting strap 10 to the foot pocket 22 of the swim fin 20 as shown in FIGS. 2 and 4.

The relative snapping position between the first snapping member 11 and the second snapping member 12 and the relative snapping position between the first snapping member 13 and the third snapping member 14 can be changed and adjusted so that the length of the adjusting strap 10 relative to the foot pocket 22 can be arbitrarily varied, thereby easily adjusting the tension and relaxation of the adjusting strap 10 relative to the user's feet so that the adjusting strap 10 can be used to fit users of different statures, thereby greatly enhancing the versatility of the adjusting strap 10.

The adjusting strap structure further comprises a flexible fam pad 15 secured on the mediate portion of the adjusting strap 10 and facing the foot pocket 22 for providing a cushioning effect and causing a comfortable sensation to the wearer. The flexible pad 15 includes an elongated body 151 defining a plurality of V-shaped lengthwise grooves 153 and a plurality of crosswise slits 154 intersecting the lengthwise grooves 153, and a protrusion 152 protruding upward from the mediate portion of the elongated body 151 and defining a plurality of V-shaped crosswise grooves 156. The lengthwise grooves 153 can be used for increasing the flexibility of the flexible pad 15 so as to fit the horizontal curvature of the user's heel, and the crosswise grooves 156 can also be used for increasing the flexibility of the flexible pad 15 so as to fit the vertical curvature of the user's heel.

The elongated body 151 also defines an elongated recess 155 for receiving the mediate portion of the adjusting strap 10 so that the flexible pad 15 can be secured to the adjusting strap 10 by sewing. The crosswise slits 154 can be used for facilitating the sewing process.

Figure 5:
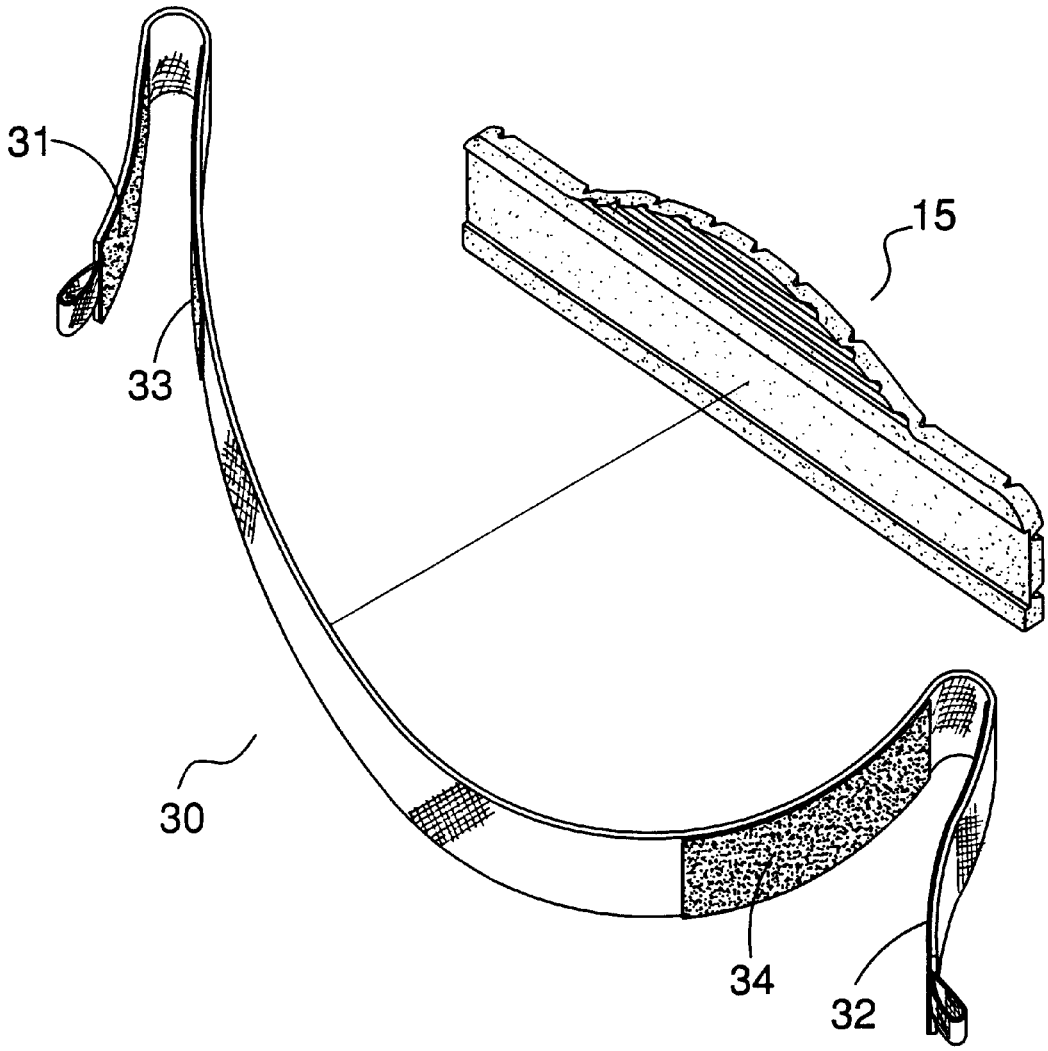
FIG. 5 is an exploded view of an adjusting strap structure for swim fins in accordance with another embodiment of the present invention.
Figure 6:
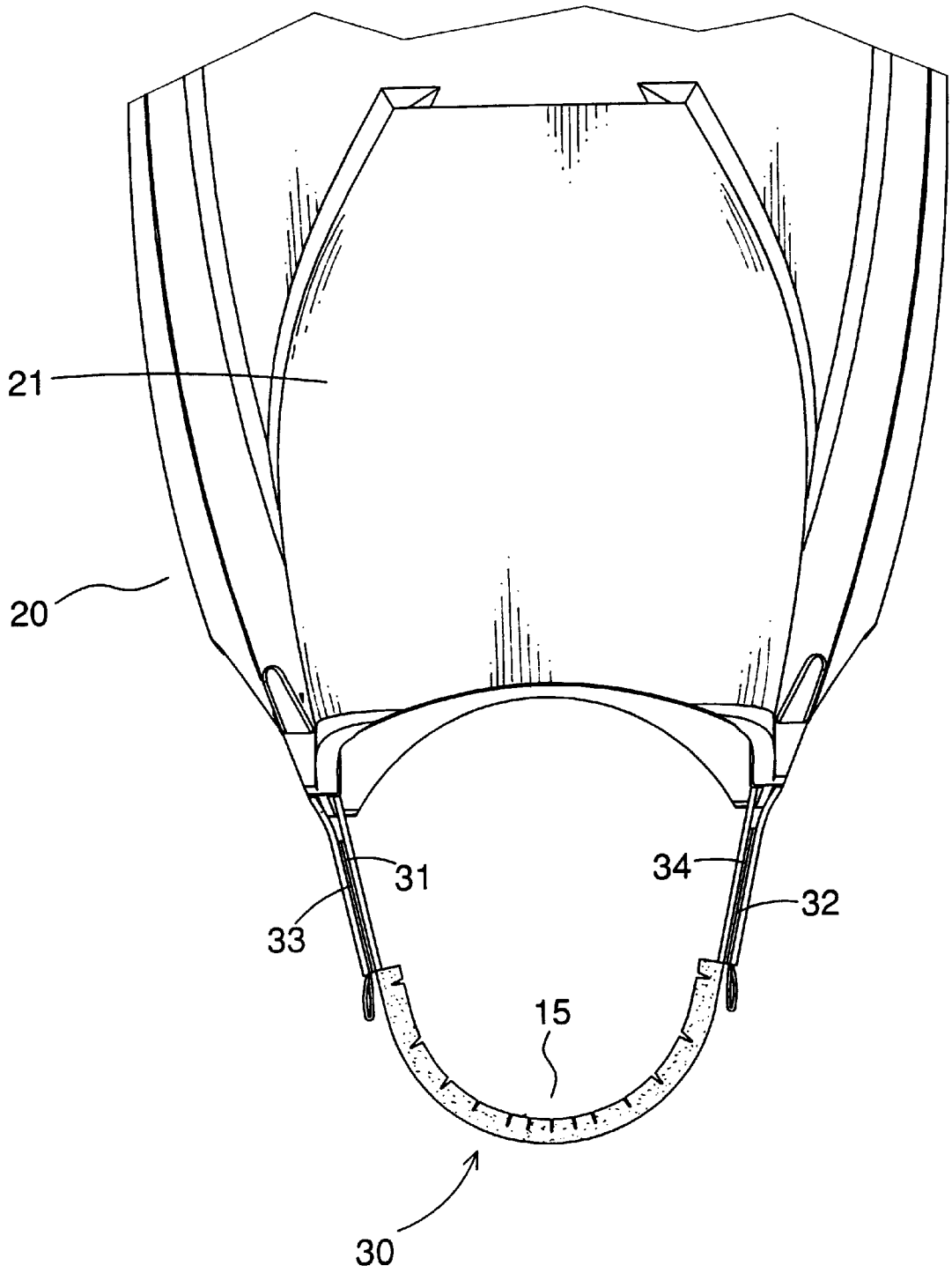
FIG. 6 is a top plan assembly view of the adjusting strap structure as shown in FIG. 5.

Referring to FIGS. 5 and 6, in accordance with another embodiment of the present invention, the adjusting strap structure comprises an elongated adjusting strap 30 including two sides each having two distal ends, two first snapping members 31 and 32 each mounted on a respective one of the two distal ends of a first side of the adjusting strap 30, and two second snapping members 33 and 34 each mounted on a respective one of the two distal ends of the first side of the adjusting strap 30 and each detachably engaged with the two first snapping members 31 and 32 respectively.

In operation, the first snapping members 31 and 32 respectively pass through the first and second holes 23 and 25 of the foot pocket 20 so as to be detachably engaged with the second snapping members 33 and 34 respectively, thereby securing the adjusting strap 30 to the foot pocket 22 of the swim fin 20 as shown in FIG. 6.

Figure 7:
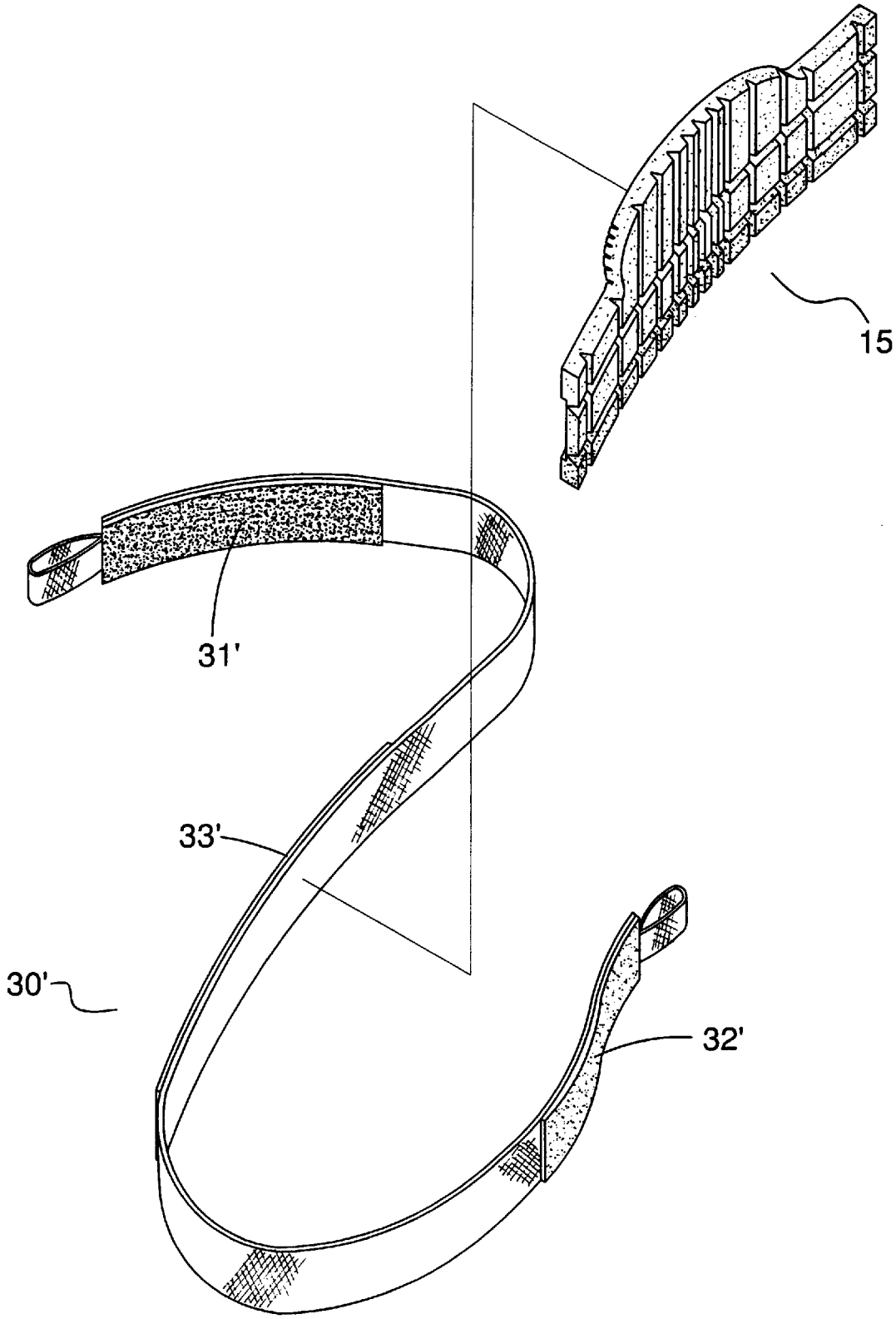
FIG. 7 is an exploded view of an adjusting strap structure for swim fins in accordance with a further embodiment of the present invention.
Figure 8:
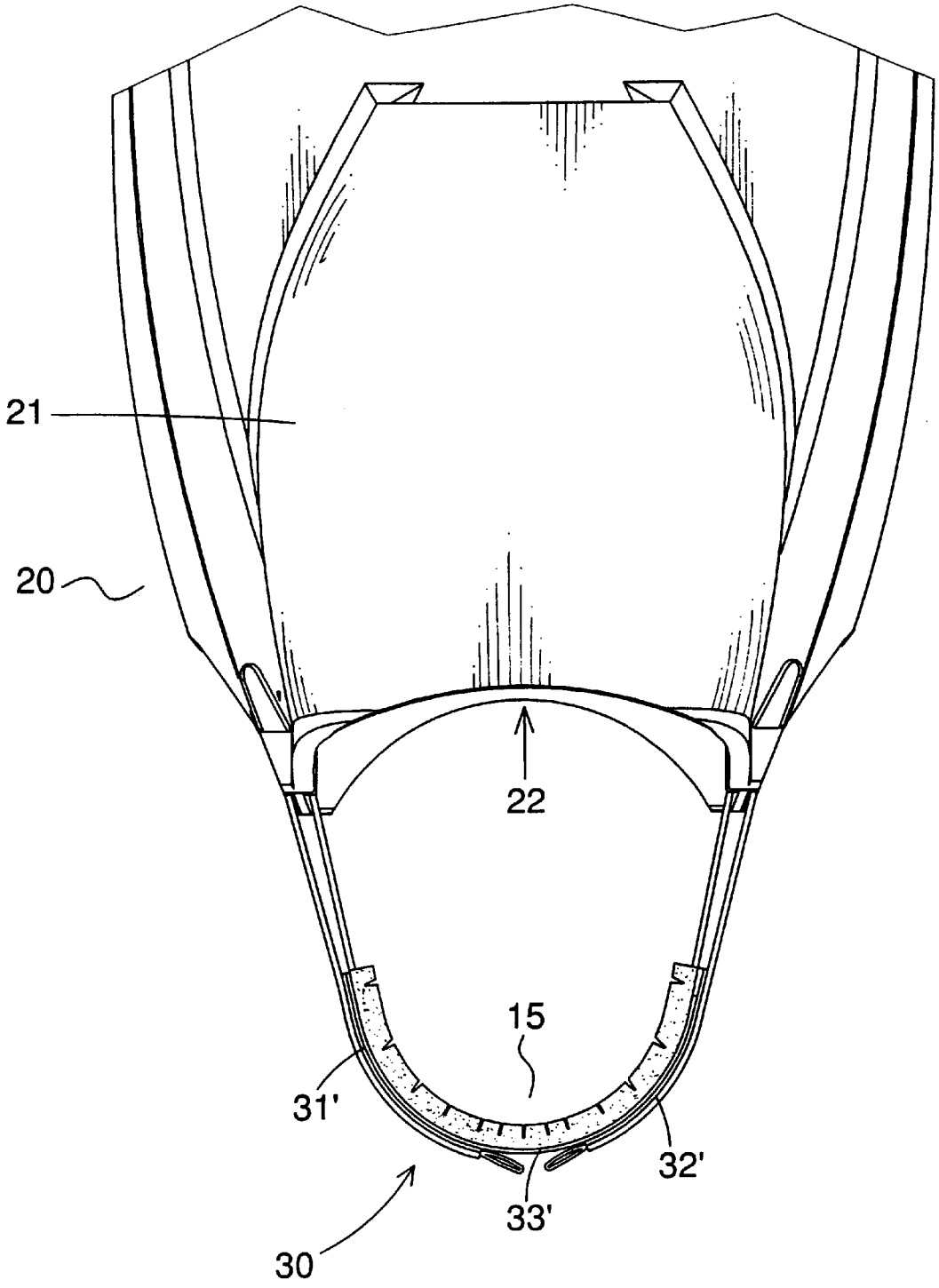
FIG. 8 is a top plan assembly view of the adjusting strap structure as shown in FIG. 7.

Referring to FIGS. 7 and 8, in accordance with a further embodiment of the present invention, the adjusting strap structure comprises an elongated adjusting strap 30' including two sides each having two distal ends, two first snapping members 31' and 32' each mounted on a respective one of the two distal ends of a first side of the adjusting strap 30', and a second snapping member 33' mounted on the mediate portion of the first side of the adjusting strap 30' and detachably engaged with the two first snapping members 31' and 32' respectively.

In operation, the first snapping member 31' passes through the first and second holes 23 and 25 of the foot pocket 20 so as to be detachably engaged with a first end of the second snapping member 33', and the other first snapping member 32' can then pass through the first and second holes 23 and 25 so as to be detachably engaged with a second end of the second snapping member 33', thereby securing the adjusting strap 30' to the foot pocket 22 of the swim fin 20 as shown in FIG. 8.

Figure 9:
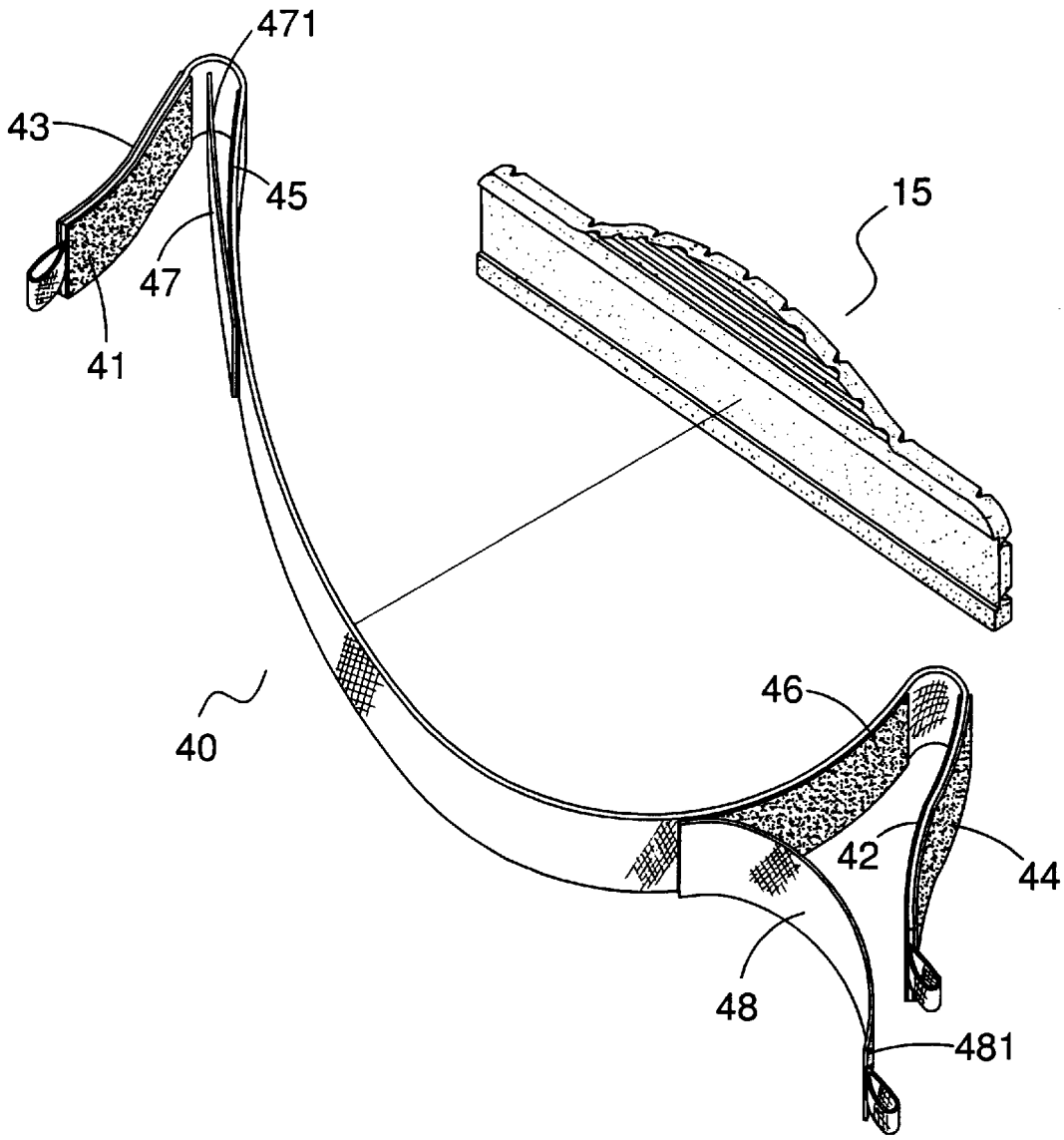
FIG. 9 is an exploded view of an adjusting strap structure for swim fins in accordance with a further embodiment of the present invention.
Figure 10:
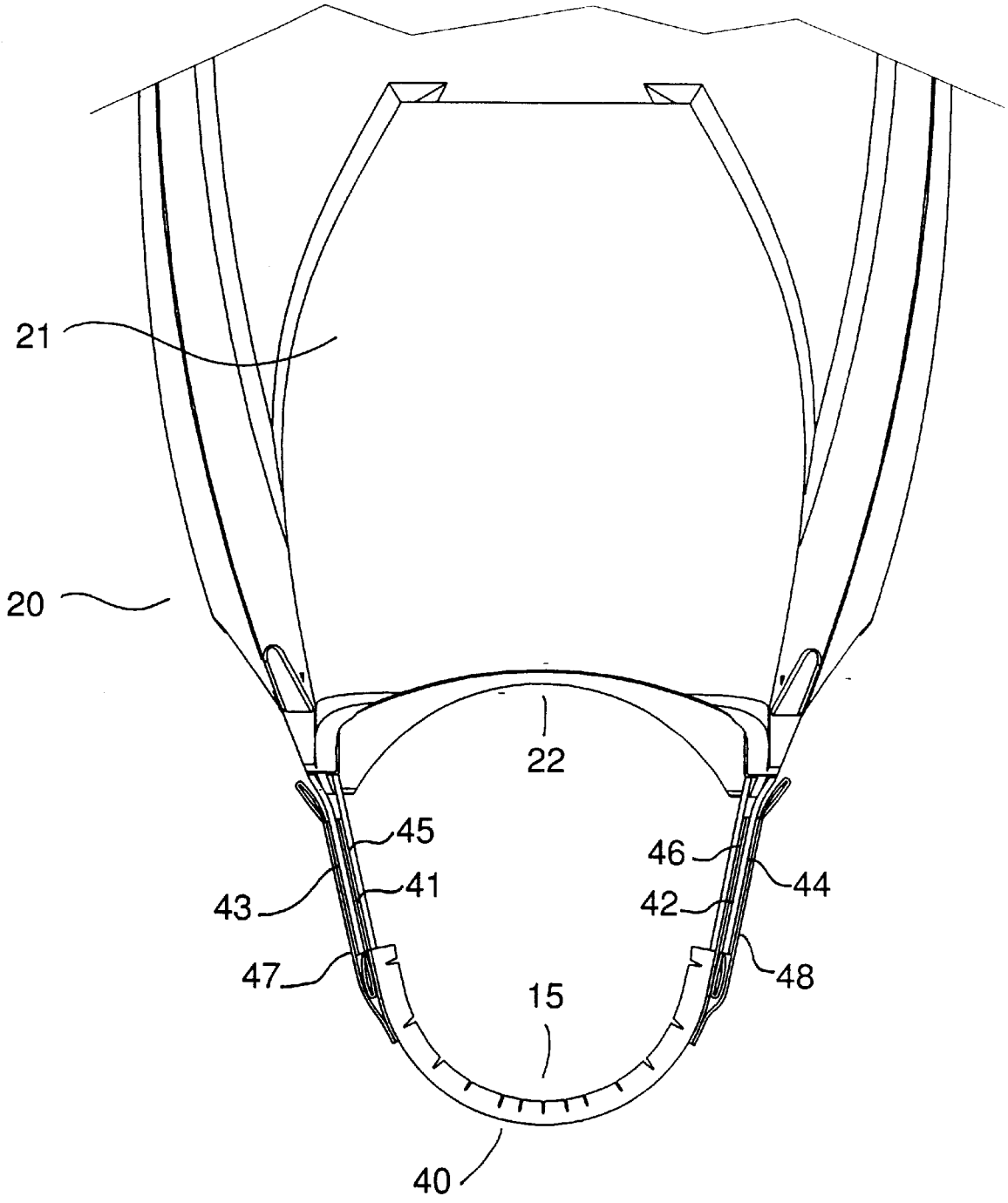
FIG. 10 is a top plan assembly view of the adjusting strap structure as shown in FIG. 9.

Referring now to FIGS. 9 and 10, according to a further embodiment of the present invention, the adjusting strap structure comprises an elongated adjusting strap 40 including two sides each having two distal ends, two first snapping members 41 and 42 each mounted on a respective one of the two distal ends of a first side of the adjusting strap 40, two second snapping members 45 and 46 each mounted on a respective one of the two distal ends of the first side of the adjusting strap 40 and each detachably engaged with the two first snapping members 41 and 42 respectively, two third snapping members 43 and 44 each mounted on a second side of the adjusting strap 40 and each located opposite to a respective one of the two first snapping members 41 and 42, and two retaining strips 47 and 48 each having one end attached or sewn to the first side of the adjusting strap 40 and each including a fourth snapping member 471 and 481 detachably engaged with a respective one of the two third snapping members 43 and 44.

In operation, the first snapping members 41 and 42 respectively pass through the first and second holes 23 and 25 of the foot pocket 20 so as to be detachably engaged with the second snapping members 45 and 46 respectively, and the fourth snapping members 471 and 481 of the retaining strips 47 and 48 are then detachably engaged with the third snapping members 43 and 44 respectively, thereby securing the adjusting strap 40 to the foot pocket 22 of the swim fin 20 as shown in FIG. 10.

Accordingly, the adjusting strap structure in accordance with the present invention can be used to conveniently and quickly adjust the length, and the tension and relaxation of the adjusting strap relative to the foot pocket of the swim fin so as to fit users of different statures, thereby increasing the versatility of the adjusting strap structure. In addition, the flexible pad can be used to protect the user's feet without the possibility of injuring the user when wearing the adjusting strap.

It should be clear to those skilled in the art that further embodiments may be made without departing from the scope of the present invention.

What is claimed is:

1. An adjusting strap structure in combination with one of a pair of swim fins, said one swim fin including a foot pocket (22) having two side walls, said adjusting strap structure comprising:

an elongated adjusting strap including two sides and having two distal ends;

two first snapping members each mounted on a respective one of said two distal ends of a first one of said two sides of said adjusting strap; and at least one second snapping member mounted on said first side of said adjusting strap and located between said two first snapping members for detachably engaging with said two first snapping members;

a third snapping member mounted on a second side of said adjusting strap and located opposite to one of said two first snapping members;

wherein, each of said two distal ends of said adjusting strap respectively extends through a respective one of said two side walls of said foot pocket (22), and each of said two first snapping members is detachably engaged with said at least one second snapping member.

2. The adjusting strap structure in accordance with claim 1, wherein each of said two side walls of said foot pocket (22) defines a first hole (23) and a second hole (25) spaced from each other, and each of said two distal ends of said adjusting strap in turn passes through said first hole (23) into said foot pocket (22), and then passes through said second hole (25) to extend outward from said foot pocket (22).

3. The adjusting strap structure in accordance with claim 1, wherein each of said two distal ends of said adjusting strap includes a pull tab mounted thereon.

4. The adjusting strap structure in accordance with claim 1, wherein said adjusting strap structure comprises a second snapping member mounted on a mediate portion of said first side of said adjusting strap and located between said two first snapping members.

5. The adjusting strap structure in accordance with claim 1, wherein said adjusting strap structure comprises two second snapping members each mounted on said first side of said adjusting strap and located adjacent to a respective one of said two first snapping members.

6. The adjusting strap structure in accordance with claim 5, further comprising two third snapping members each mounted on a second side of said adjusting strap and each located opposite to a respective one of said two first snapping members, and two retaining strips each having one end attached to said first side of said adjusting strap and each including a fourth snapping member detachably engaged with a respective one of said two third snapping members.

7. The adjusting strap structure in accordance with claim 1, further comprising a flexible pad (15) secured on a mediate portion of said adjusting strap and facing said foot pocket (22), wherein said flexible pad (15) includes an elongated body (151) defining a plurality of lengthwise grooves (153) and a plurality of crosswise slits (154) intersecting said lengthwise grooves (153).

8. The adjusting strap structure in accordance with claim 7, wherein said flexible pad (15) further includes a protrusion (152) protruding outward from a mediate portion of said elongated body (151) and defining a plurality of crosswise grooves (156).

9. The adjusting strap structure in accordance with claim 7, wherein said elongated body (151) defines an elongated recess (155) for receiving said mediate portion of said adjusting strap.

* * * * *